US006544714B1

(12) United States Patent
Bourdelais et al.

(10) Patent No.: US 6,544,714 B1
(45) Date of Patent: Apr. 8, 2003

(54) NACREOUS PHOTOGRAPHIC PACKAGING MATERIALS

(75) Inventors: Robert P. Bourdelais, Pittsford, NY (US); Peter T. Aylward, Hilton, NY (US); Alphonse D. Camp, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,541

(22) Filed: Aug. 16, 2001

(51) Int. Cl.[7] ..... G03C 1/12; G03C 1/805; G03C 1/79; G03C 1/795; G03C 1/91

(52) U.S. Cl. ..... 430/263; 430/256; 430/259; 430/262; 430/510; 430/512; 430/523; 430/527; 430/533; 430/536; 430/538; 430/961

(58) Field of Search ..... 430/256, 259, 430/262, 263, 510, 512, 523, 527, 533, 536, 961, 538

(56) References Cited

U.S. PATENT DOCUMENTS

| | | | | |
|---|---|---|---|---|
| 4,216,018 A | | 8/1980 | Bilofsky et al. | 430/220 |
| 4,242,428 A | * | 12/1980 | Davis | 430/9 |
| 4,269,916 A | | 5/1981 | Bilofsky et al. | 430/220 |
| 4,288,524 A | | 9/1981 | Bilofsky et al. | 430/220 |
| 4,910,235 A | * | 3/1990 | Satake et al. | 523/171 |
| 5,340,692 A | | 8/1994 | Vermeulen et al. | 430/233 |
| 5,466,519 A | | 11/1995 | Shirakura et al. | 430/538 |
| 5,733,658 A | | 3/1998 | Schmid et al. | |
| 5,858,078 A | | 1/1999 | Andes et al. | |
| 5,866,282 A | | 2/1999 | Bourdelais et al. | 430/536 |
| 5,888,681 A | | 3/1999 | Gula et al. | 430/536 |
| 6,030,759 A | | 2/2000 | Gula et al. | 430/536 |
| 6,045,965 A | * | 4/2000 | Cournoyer et al. | 430/259 |
| 6,071,654 A | | 6/2000 | Camp et al. | 430/536 |
| 6,071,680 A | | 6/2000 | Bourdelais et al. | 430/536 |
| 6,146,744 A | | 11/2000 | Freedman | 428/213 |
| 6,274,284 B1 | | 8/2001 | Aylward et al. | 430/97 |

FOREIGN PATENT DOCUMENTS

JP 61/259246 * 11/1986

OTHER PUBLICATIONS

Derwent Abstr. of JP 61/259,246, Nov. 1986.*
J PAB Abstr of JP 61/259,246, Nov. 1986.*

* cited by examiner

*Primary Examiner*—Richard L. Schilling
(74) *Attorney, Agent, or Firm*—Paul A. Leipold

(57) ABSTRACT

The invention relates to a packaging material comprising at least one layer comprising photosensitive silver halide, at least one layer comprising nacreous pigment, and at least one layer comprising a pressure sensitive adhesive.

43 Claims, 1 Drawing Sheet

NACREOUS PHOTOGRAPHIC PACKAGING MATERIALS

FIELD OF THE INVENTION

The invention relates to packaging materials. In a preferred form it relates to the use of silver halide pressure sensitive label for the printing of text, graphics and images applied to packaging material.

BACKGROUND OF THE INVENTION

Prior art reflective imaging output materials such as silver halide reflective images or ink jet reflective images typically comprise imaging layers applied to a white reflective base material. The white reflective base reflects ambient light back to the observer's eye to form the image in the brain. Prior art base materials typically utilize white reflecting pigments such as $TiO_2$ or barium sulfate in a polymer matrix to form a white reflective base material. Prior art reflective photographic papers also contain white pigments in the support just below the silver halide imaging layers to obtain image whiteness and sharpness during image exposure, as the white pigment reduces the amount exposure light energy scattered by the cellulose paper core. Details on the use of white pigments in highly loaded coextruded layers to obtain silver halide image sharpness and whiteness are recorded in U.S. Pat. No. 5,466,519.

It has been proposed in U.S. Pat. No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. The composite imaging support structure described in U.S. Pat. No. 5,866,282 has been found to be more durable, sharper and brighter than prior art photographic paper imaging supports that use cast melt extruded polyethylene layers coated on cellulose paper.

It has been proposed in U.S. Pat. No. 6,071,680 (Bourdelais et al) to utilize a voided polyester sheet coated with light sensitive silver halide imaging layers for use as photographic output material. The voided layer in U.S. Pat. No. 6,071,680 improves opacity, image lightness, and image brightness compared to prior art polyethylene melt extrusion coated cellulose paper base materials. The image base proposed in U.S. Pat. No. 6,071,680 also contains an integral polyolefin skin layer to facilitate imaging layer adhesion at the time of manufacture and during the processing of silver halide imaging layers.

There, however, remains a continuing need for improvements to the appearance of imaging output materials. It has been shown that consumers, in addition to reflective output material, also prefer nacreous images. Nacreous images exhibit a pearly or nacreous luster, an iridescent play of colors, and a brilliant luster that appears in three dimensions. Nacreous appearance can be found in nature if one examines a pearl or the polished shell of Turbo marmoratus.

A nacreous photographic element with a microvoided sheet of opalescence is described in U.S. Pat. No. 5,888,681 (Gula et al). In U.S. Pat. No. 5,888,681 microvoided polymer sheets with microvoided polymer layer located between a cellulose paper base and developed silver halide imaging provide an image with an opalescence appearance. The nacreous appearance is created in U.S. Pat. No. 5,888,681 by providing multiple internal reflections in the voided layer of the polymer sheet. While the opalescence appearance is present in the image, the image suffers from a loss of image sharpness or acutance, a higher density minimum position, and a decrease in printing speed compared to a typical photographic image formed on a white, reflecting base. It would be desirable if the opalescent look of the image could be maintained while improving printing speed, increasing sharpness, and decreasing density minimum. Also, while the voided polymer does provide an excellent nacreous image, the voided layer, because it is pre-fractured, is subjected to permanent deformation, thus reducing the quality of the image.

In addition to the use of white pigments in reflective consumer photographs, white pigments are also utilized in photographic display materials for diffusion of illumination light source. While the use of white pigments in display materials does provide the desired diffusion and reflection properties, the white pigments tend to change the hue angle of the color dyes in a developed photographic display image. Dye hue angle is a measure in CIElab color space of that aspect of color vision that can be related to regions of the color spectrum. For color photographic systems there is a perceptual preferred dye hue angle for the yellow, magenta, and cyan dyes. It has been found that when photographic dyes are coated on support containing white pigments, the hue angle of the developed image changes compared to the hue angle of the dyes coated onto a transparent support. The hue angle change of photographic dyes caused by the presence of white pigments often reduces the perceived quality of the dyes compared to the dye set coated on a transparent base that is substantially free of white pigments. It would be desirable if a developed photographic dye set coated on a reflective support material had a dye hue angle that was not significantly different than the same dye set coated on a transparent support.

Nacreous pigments added to a matrix, such as paint or plastic, have been known to exhibit a nacreous appearance. The prior art use of the nacreous pigments have been for pigmenting paints, printing inks, plastics, cosmetics, and glazes for ceramics and glass. Nacreous pigments are dispersed in a matrix and then painted or printed onto a substrate. Pearl luster pigments containing titanium dioxide have been successfully employed for many years. They are constructed in accordance with the layer substrate principle, with mica being employed virtually without exception as substrate.

Mica pigments are used widely in the printing and coating industries, in cosmetology, and in polymer processing. They are distinguished by interference colors and a high luster. For the formation of extremely thin layers, however, mica pigments are not suitable, since the mica itself, as a substrate for the metal-oxide layers of the pigment, has a thickness of from 200 to 1200 nm. A further disadvantage is that the thickness of the mica platelets within a certain fraction defined by the platelet size in some cases varies markedly about a mean value. Moreover, mica is a naturally occurring mineral which is contaminated by foreign ions. Furthermore, technically highly complex and time-consuming processing steps are required including, in particular, grinding and classifying.

Pearl luster pigments based on thick mica platelets and coated with metal oxides have, owing to the thickness of the edge, a marked scatter fraction, especially in the case of relatively fine particle-size distributions below 20 micrometers. As a substitute for mica, it has been proposed to use thin glass flakes which are obtained by rolling a glass melt with subsequent grinding. Indeed, interference pigments based on such materials exhibit color effects superior to those of conventional, mica-based pigments. Disadvantages, however, are that the glass flakes have a very large mean thickness of about 10–15 micrometers and a very broad thickness distribution (typically between 4 and 20 micrometers), whereas the thickness of interference pigments is typically not more than 3 micrometers.

In U.S. Pat. No. 5,340,692 (Vermeulen et al) an imaging receiving material with nacreous pigment for producing contone images according to the silver salt diffusion process is disclosed. According to the process disclosed in U.S. Pat. No. 5,340,692, contone images with an antique look can be obtained utilizing the silver salt diffusion transfer process without the need of special processing liquids using a nacreous pigment in the imaging receiving layer or located between the support and the image receiving layer. The silver halide imaging layers used are created with retained silver and, therefore, are not semitransparent. Because the nacreous pigments used are contained in the imaging receiving layer and not silver halide imaging layer, the image form will not have a uniform nacreous appearance, as the density of the transferred silver halide image block the multiple reflections from the nacreous pigments. Further, the nacreous pigments utilized are too large and in too great a concentration to be included in the silver halide imaging layer as a rough surface would result, reducing the desired nacreous appearance of the image. The gold flakes used in the example in U.S. Pat. No. 5,340,692 are an attempt to simulate prior art black-and-white photographic "Sepatone" appearance produced during a post process treatment of the imaging layers. While the image in the example does have an antique appearance, the image does not have a nacreous appearance.

In U.S. Pat. No. 4,269,916 (Bilofsky et al) and related patents U.S. Pat. Nos. 4,288,524 and 4,216,018, instant photographic products having reflective layers which comprise lemellar interference pigments are disclosed. The intended use of the lemellar pigments is to create a pleasing white reflective appearance for the base material without the need for blue tints. It has been proposed that flat particles of metal oxides created by coating salts with metal oxides and later dissolving the salts leaving a thin flake of metal oxide as a substitute for spherical $TiO_2$ particles. Titanium dioxide particles typically are utilized in photographic art to create a white reflective surface for the viewing of print materials. The intent of U.S. Pat. No. 4,269,916 is to provide a white reflecting surface that does not have an angular viewing appearance and a consistent L*, thus the invention materials do not exhibit a nacreous appearance. Examples in U.S. Pat. No. 4,269,916 show high reflectivity at a variety of collection angles which is opposite of a nacreous appearance where reflectivity changes as a function of collection angle. Further, the lemellar pigments are not present in the silver halide imaging layers or in the base materials used in the invention.

In U.S. Pat. No. 5,858,078 (Andes et al), a process for the production platelet like, substrate free $TiO_2$ pigment is disclosed for use in printing inks, plastics, cosmetics and foodstuffs.

In U.S. Pat. No. 5,733,658 (Schmid et al) luster pigments obtainable by treating titania coated silicate based platelets from 400° C. to 900° C. with a gas mixture comprising a vaporized organic compound and ammonia are described as useful for coloring paints, inks, plastics, glasses, ceramic products, and decorative cosmetic preparations.

In U.S. Pat. No. 6,146,744 (Freedman) high aspect ratio filler particles are added to composite facestock and liner sheets to provide increased mechanical stiffness compared to polymer facestock and liner materials that do not contain filler particles. While high aspect ratio filler particles added to the base layer in an amount between 5% to 40% by weight does improve the stiffness of the liner and facestock, the filler particles do not provide a nacreous appearance. Further, the high aspect ratio particles are added to the core of the facestock and liner and not to the printed layers. It has been shown that high aspect ratio particles added to the core of a facestock do not provide adequate multiple reflection planes in combination with a dye based imaging system to provide the desired nacreous appearance. High aspect ratio particles provide a nacreous appearance when they are located adjacent to the dye based imaging layers. Further, not attempt was made to improve the reflectivity of the high aspect ratio particles and thus are not suitable for the formation of photographic images.

When imaging supports are subject to variations in ambient conditions over long periods of time, the image-containing layers and resin layers tend to deteriorate into a mass of cracks which are aesthetically undesirable and which, in extreme cases, extend over the entire print completely destroying the image. All polymers are inherently prone to chemical degradation that leads to loss of mechanical properties. They undergo thermal degradation during processing such as extrusion of thin films, and photooxidative degradation with long-term exposure to light. The $TiO_2$ utilized in U.S. Pat. Nos. 5,858,078 and 5,733,658 catalyzes and accelerates both thermal and photooxidative degradation. In the art of resin coating imaging papers, the melt polymers are extruded at high temperatures and are also subjected to high shear forces. These conditions may degrade the polymer, resulting in discoloration and charring, formation of polymer slugs or "gels", and formation of lines and streaks in the extruded film from degraded material deposits on die surfaces. Also, thermally degraded polymer is less robust than non-degraded polymer for long-term stability, and may thereby shorten the life of the print.

It has been shown that when imaging layers (silver halide, ink jet, flexography, laser toner, and the like) are applied to nacreous base materials, the nacreous appearance of the image is optimized when the image forming layers contain semitransparent dyes. The use of pigmented inks and dyes in the imaging layers tend to reduce the nacreous appearance of the image. In U.S. Pat. No. 6,071,654 (Camp et al) silver halide imaging layers that are semitransparent are coated on a nacreous support containing a voided polymer layer. The voided polymer layers create flat platelets oriented parallel to each other. The reflection which reaches the eye is primarily specular. It arises in depth, since each transparent polymer platelet reflects some of the incident light and reflects the remainder. The images in U.S. Pat. No. 6,071,654 exhibit a nacreous appearance.

Photographic materials have been known for use as prints for preserving memories for special events such as birthdays and vacations. They also have been utilized for large display materials utilized in advertising. These materials have been known as high quality products that are costly and somewhat delicate as they would be easily defaced by abrasion, water, or bending. Photographs are traditionally placed in frames, photo albums, and behind protective materials in view of their fragile and delicate nature, as well as their value. They are considered luxury items for the consumers to preserve a record of important events in their lives. They also have been considered as expensive display materials for advertising. In view of their status as luxury items, they have not been utilized in other areas of commerce.

There is a continuing need for packaging materials that have high quality graphics and images to enhance product brands at retail. Further, there is a continuing need for packages to attract the attention of the consumer at retail while maintaining the quality of the graphics and image.

PROBLEM TO BE SOLVED BY THE INVENTION

There is a need for pressure sensitive labels for application to packages that are high in quality and at the same time economical for short runs. There is a further need for the images to exhibit a nacreous appearance.

SUMMARY OF THE INVENTION

It is an object of the invention to provide higher quality images to packaging materials.

It is a further object to provide a silver halide imaging system labels that have bright, sharp, nacreous images.

It is another object to provide a label base material that has a nacreous appearance.

These and other objects of the invention are accomplished by a packaging material comprising at least one layer comprising photosensitive silver halide, at least one layer comprising nacreous pigment, and at least one layer comprising a pressure sensitive adhesive.

ADVANTAGEOUS EFFECT OF THE INVENTION

The invention provides improved image quality for packaging materials. The invention includes a printing method that can print text, graphic and images using negative working optical systems or optical digital printing systems for the formation of a nacreous silver halide pressure sensitive label for packaging.

DETAILED DESCRIPTION OF THE INVENTION

Figure 1:
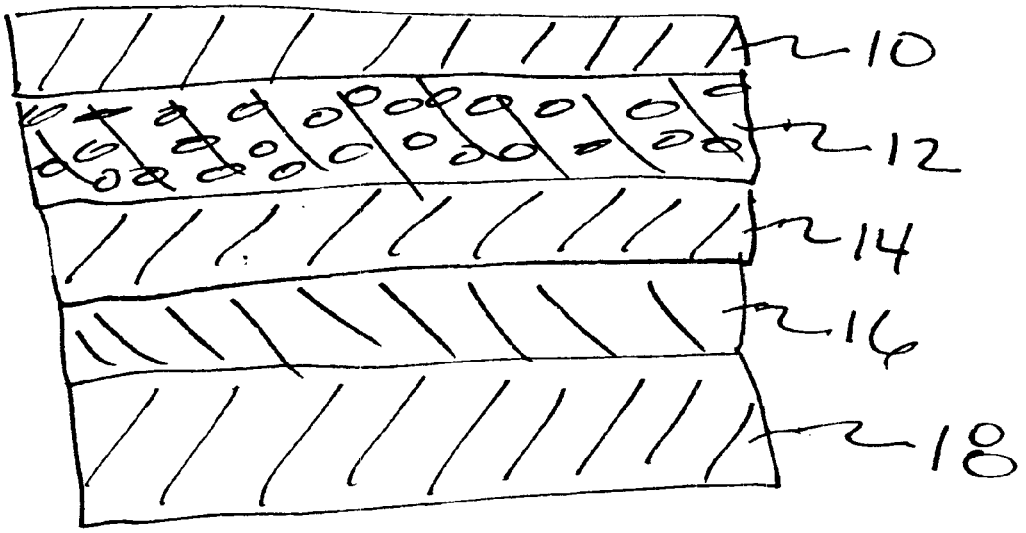
FIG. 1 is an illustration of the structure of an imaged nacreous silver halide pressure sensitive label on a paper liner.

The invention has numerous advantages over prior art printed pressure sensitive labels. The reflective materials of the invention provide a photographic label with a nacreous appearance while maintaining efficient reflection of light, sharpness, and photographic speed. Maintaining image sharpness and whiteness is important, as consumers expect silver halide images to be high in quality. Further, maintaining printing speed is critical for efficient photographic processing, as a significant loss in printer speed could increase the cost of labels. Because the silver halide formed imaging layers of the invention are semi transparent, the imaging layers can be used in combination with a nacreous base or coated compared to pigmented printing inks utilized for printing of packaging labels, which do not allow the effective use of a nacreous base or coating.

The nacreous imaging materials of the invention provide an eye-catching appearance that make them particularly desirable in imaging applications that require obtaining the attention of the consumer. One example includes display materials that are intended to communicate an advertising message to people in a public setting such as a bus stop, train station, or airport. The nacreous images are differentiated in look from prior art materials and, thus, provide the pop and sizzle that can catch the consumer's attention. By providing the nacreous image with a pressure sensitive adhesive, the tough, durable nacreous image can be applied to various surfaces, which is particularly desirable for the youth market.

Photographic nacreous labels of the invention utilized in packaging markets enable a differentiated look and consumer appeal on store shelf. The utilization of the thin, flexible, and tough silver halide materials results in a packaging material having many superior properties. The packaging materials of the invention have a depth of image unsurpassed by existing packaging materials. The packaging materials of the invention may be utilized with a variety of packaging materials that are suitable pressure sensitive labeling, such as shampoo bottles, perfume bottles, and film boxes. The packaging materials of the invention, while having the advantage of superior image, are available on thin base materials which are low in cost while providing superior opacity and strength. The packaging materials of the invention, as they may be imaged by flash optical exposure or digital printing, have the ability to be formed in short runs and to be rapidly switched from one image to the next without delay.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image. Nacreous appearance is a pearly, luster, iridescent, metallic sheen. A characteristic property of a nacreous appearance is an angular dependence of viewing angle.

For the packaging material of the invention, at least one layer consisting of a nacreous pigment is located between the top of the imaging layers and the bottom of the pressure sensitive adhesive layer. By locating a nacreous pigment between the top of the imaging layer and the bottom of the adhesive layer, the silver halide formed image appears nacreous and thus has great value as a packaging label. In the invention a photographic element comprises nacreous pigments. Such a photographic label element has a unique capability to preserve images with special luster sheen that is not available in traditional printed labels or commercial displays that utilize pigmented inks. A preferred embodiment of this invention comprises nacreous material in a photographic layer which is on a white reflective label base. The white reflective label base provides an excellent surface and background while viewing labels. In particular, it is desirable to have a white reflective base that has an L* of greater than 92. L* greater than 92 are desirable because they provide good contrast to the image and are pleasing to the consumer. L* or lightness and opacity were measured for using a Spectrogard spectrophotometer, CIE system, using illuminant D6500.

In a further embodiment of this invention the nacreous pigments are added to the polymer facestock. Addition to the facetock provides a unique appearance to the silver halide packaging labels as the nacreous pigments are aligned during the orientation process utilized in the manufacture of label facestock materials of this invention. Alignment of the nacreous pigment during orientation has been shown to provide multiple reflection planes for the formation of the nacreous image while using approximately 50% less than cast coated facestock materials. Further, the nacreous pigment addition to the facestock and the silver halide imaging layers provides a two tiered appearance as nacreous pigment in the imaging layers tends to be more scattering (as the pigments tend to have a random orientation) and the nacreous pigments in the facestock tend to be more specular as they are oriented. The two tiered appearance is the result of the nacreous of the nacreous pigment in the emulsion and nacreous pigment in the facestock.

Because the nacreous imaging element is directed at labeling of packages, the color gamut of the nacreous pigment is expanded beyond the color gamut of traditional imaging methods that typically utilize pigments that are white and reflecting and blue tints that off set the native yellowness of the gelatin binder. The preferred color of the nacreous pigments for the invention includes colors that are within the following range; a* from −20 to +20 and b* from −20 to +20 (utilizing CIELAB color space). Nacreous pigments is this range provide several color positions that have significant commercial value. An example is a oxide coated mica pigment that has an a* value of +18 and a b* value of −8 and a hue angle of 320 degrees. This nacreous pigment when applied to a pressure sensitive label has a nacreous rose/red wine color that accentuates bottled red wine.

For the purpose of this invention the photographic element comprises silver halide emulsion. Said silver halide emulsion may comprise more than one layer. It should also be noted that some layers may comprise light sensitive silver halide materials, and other layers may not contain light sensitive materials.

In this invention the photographic label element comprises nacreous pigments. The element may have nacreous pigment in a layer that comprises silver halide emulsion; that is, the nacreous pigment is in the same layer or layers that have the light sensitive silver halide emulsion. After the silver halide is exposed and processed, the nacreous pigment provides a source of additional spectral reflection that provides a unique appearance to the image. Since the silver halide emulsion has more than one layer, and in the case of color emulsions there may be at least three or more layers each capable of capturing light of a different wavelength, said nacreous pigment may be in one or more layers. This will allow only certain colors or all colors to demonstrate the nacreous appearance.

The term "nacreous" refers to a pearly, luster, and nacreous appearance. This may include a metallic, lustrous, and somewhat iridescent effect. The nacreous effect is the result of interference pigments that are platelet-like in their structure. Typically these are elongated platelet-like structures of silicate-based materials such as mica, feldspar, and quartz. These pigments tend to cause specular and diffuse reflection, and they also transmit some light. The use of nacreous pigments in the paint and printing industry are typically designed to create a variety of eye-popping colors. These materials are typically coated over dark black backgrounds to help accentuate the eye-popping optical effects. Special metal oxide coatings are applied to mica particles in very thin layers. This allows for some light to be refracted, while other light will transmit through to the near transparent layers of the mica particle to be refracted at a slightly different angle. Since these pigments are suspended in a binder polymer of yet another refractive index, there are multiple light refractions that create a lustrous appearance. In addition, the chemistry of the coating that is applied to the mica particles may be varied to create various colors.

Metal oxide coatings that may be used in an embodiment of this invention include titanium, iron, chromium, barium, aluminum, zinc, zirconium, bismuth vanadate, nickel titanate, chromium titanate, lead, and others. While these produce some exciting colors in the field of photography and imaging, traditional print materials have a white background. Additionally, it should be noted that the thickness of the metal oxide coating on the mica may also impact the color. In a preferred embodiment of this invention the metal oxide coating on the mica particles may comprise titanium, aluminum, and/or barium. These materials are preferred because it is desirable to have a more traditional white background that can be achieved with these materials. The most preferred metal oxide is titanium because of its superior whiteness. Typically it is important to control the thickness of the metal oxide coating to less than 120 nanometers to achieve a blue white appearance.

With nacreous pigments used in imaging application, it is desirable to have non-uniform platelet thickness and small particles to create a white nacreous appearance. In imaging applications where a different look is desirable, the use of thicker particles and more uniform spacing of platelets to each other creates a color interference that is more characteristic of mother-of-pearl. In general, the lustrous pigments referred to in this invention are pigments that consist of flat mica platelets coated with titanium dioxide or other metal oxides. They are irregular in shape and may vary in thickness from 0.1 to 0.5 micrometers, although some individual particles may be thicker. The particles may have a length of up to 500 micrometers. The coating applied to the mica particles should be controlled in thickness, but the overall thickness is one parameter that controls the overall color appearance. Each transparent coating helps to create the lustrous or pearlescent effect.

The particle of these pigments influences the perceived texture of the pearl luster effect and adds a new dimension of beauty and quality to the image. The coating may be colored with other compatible transparent pigments and dyestuffs. Metallic effects can be simulated by adding small amounts of carbon black with some silvery white pigments. The color seen is different than color pigments and dyes in that the color and lustrous iridescence is produced by light interference and not absorption or reflection of light. This is a suprisingly unique attribute to the field of silver halide photography and imaging. With the use of nacreous pigments there are many refractive interface that can produce a unique appearance to an imaging element. A light ray striking a layer containing nacreous platelets must pass through a substantially transparent layer of relatively lower refractive index binder polymer surrounding the platelet, and then the ray is then partially reflected by the metal oxide coating on the surface. The remaining part passes into the metal oxide coating layer and is again reflected as it exits the layer at the interface with the mica particle. Since the coating is very thin and the mica platelets are substantially transparent, the remaining light has many opportunities to be reflected at different angles. This helps to provide the luster nacreous appearance, as well as to add a three-dimensional quality to the image. The resulting color effect that is produced depends on the light reflection from the interfaces, as well as the type of coating on the mica particles. The multiple interfaces cause the reflected light to be slightly out of phase. It should also be noted that the color varies based on the angle of illumination and that an iridescence effect can be seen.

Control of this effect is desirable depending on the effect that needs to be conveyed by the image. As noted above the thickness and type of the coating on the mica particles are factors that need to be considered. In addition the particle size can also be used to control the effect. For use in a photographic element it is desirable to have a smooth surface. To achieve this, a small particle is best but the layer thickness of the binder polymer in which the pigments are suspended may also be increased as well as applying clear overcoats. Larger particles are desirable when a bold effect with visual impact is desired. The nacreous effect can be changed by adjusting the particle size, metal oxide coating thickness and type, as well as the concentration of the pigment. In general, low pigmentation levels are better at producing a three-dimensional effect. This effect may be enhanced by applying a thick clear layer over the top of the nacreous pigments. When a more metallic sheen is desired, higher pigmentation levels are best. It should also be noted that different effects may be achieved by adding other transparent pigments and dyes in the layers. Since light sensitive photographic layers produce dye couplers that are semitransparent and typically do not contain pigment particles; they are uniquely positioned to be able to create synergistic effects with the nacreous pigments.

The nacreous pigments are relatively stable and generally resistant to alkali and acids, as well as high temperature. They can be dispersed in most carrying (binder polymer) media. Since the particles are substantially transparent, the use of a carrying media that is also transparent provides the maximum effect. If a more translucent carrying media is used, more nacreous pigment may be needed to achieve the same level of nacreous appearance.

In some applications it may be desirable to also have a nacreous pigment that is also conductive. This has some unique advantages in the area of photography that uses light sensitive layers. Static accumulation and discharge can result in a fogged layer. Being able to provide a conductive path that helps to prevent the charge from building up is an important element for imaging media. This not only helps prevent light fogging of light sensitive layer, but also allows sheets to slide over each other and various equipment parts without static buildup or cling of one sheet to another. This type of pigment is also a means of adding conductivity to the emulsion side of a photographic element. Conductive nacreous pigments consist of an inner core of platelet mica that is coated with materials such as $TiO_2$, $SiO_2$ and further coated with an outer dense layer of conductive, inorganic mixed metal oxide. A typical conductive material is antimony-doped tin dioxide. The elongated particles of mica are useful in providing a conductive pathway when particles are touching.

The origin of the beauty of a genuine pearl has been well documented. It is known that its luster and color come from the multiple smooth concentric layers of nacre, i.e., calcium carbonate layer, organic constituent (conchiolin) layer. Each of these layers partially reflects and transmits light. Hence, a sense of depth and luster is observed in the reflection. Pigments that try to simulate the visual effect of a pearl are called as pearlescent or nacreous pigments. The first nacreous pigment was the natural pearl. The commercial grades of nacreous pigments are made of thin transparent platelets of high refractive index. These pigments are so designed that multiple reflections and transmissions occur and, as a result, a sense of depth is obtained in the overall reflected image. The characteristics of the pigment determine whether color is produced by light interference (specifically called as interference pigments) or no color is produced (called as white nacreous pigments).

Some of the earliest pearlescent pigments were the platelike bismuth oxychloride crystals, and basic lead carbonate. These pigments reflect light similar to a pearl essence crystal. Due to toxicity of lead, bismuth oxychloride (BiOCl) crystals have seen an increased use in the marketplace. BiOCl is generally crystallized from solution into smooth, thin platelets which have a particle size ranging from 5 $\mu$m to 15 $\mu$m.

The other commonly used pearlescent pigments are those made from mica coated with either titanium dioxide (U.S. Pat. No. 4,040,859), iron oxide (U.S. Pat. No. 3,087,829), zirconium dioxide (U.S. Pat. No. 3,087,828), or other high refractive index materials. Mica is used because it is transparent to light and can be cleaved into extremely thin flakes. Examples of mica suitable for pearlescent pigments are muscovite, paragonite, phlogopite, biotite, and lepidolite. The mica platelets are then coated with a thin single layer or multiple layers of high refractive index inorganic oxide. The reflection efficiency depends to a large extent on the refractive index difference between the mica platelet and the inorganic oxide coating. This layered structure enables it to function like a pearlescent pigment. The oxide coating provides the optical effects like luster, interference reflection color (if oxide coating is sufficiently thick) and absorption color (if the oxide contains color material). The size of the mica particle also plays an important role in determining the final reflected image. The weight of the mica in the pigment usually lies between 40% and 90% and most usually in the range of 60% and 80%. If titanium dioxide is used as the coating and its coating thickness is increased, then an iridescence effect (color) is observed. The dimensions of pearlescent pigments used in this invention may be between 5 $\mu$m and 400 $\mu$m and preferably between 5 $\mu$m and 100 $\mu$m because particles less than 5 $\mu$m are not very efficient in creating the nacreous appearance, while particles greater than 100 $\mu$m progressively get rougher. Excessive roughness on the surface tends to shut down the nacreous appearance. The thickness of the pigment is preferably between 0.1 $\mu$m and 0.6 $\mu$m and more preferably between 0.2 $\mu$m and 0.4 $\mu$m. Particles less than 5 $\mu$m or less than 0.2 $\mu$m typically do not have sufficiently higher nacreous appearance, while particles greater than 400 $\mu$m in length or 0.6 $\mu$m in width typically are very large and tend to create roughness which starts to shut down the nacreous effect.

Other optically variable pigments that are suitably used are silicon oxide coated with thin layers of aluminum (5 nm and 10 nm) or titanium dioxide, and magnesium fluoride crystals coated with chromium have also been used. These pigment structures have been highlighted in U.S. Pat. No. 3,438,796. New optically variable pigment structures based on coated platelet like metallic substrates have been disclosed in U.S. Pat. Nos. 5,364,467 and 5,662,738. U.S. Pat. No. 5,976,511 discloses pigments composed of barium sulfate particles and coated with zinc oxide, cerium oxide, or titanium dioxide which have a pearly luster.

The photographic label elements of this invention may utilize an integral emulsion bonding layer that allows the emulsion to adhere to the support materials during manufacturing and wet processing of images without the need for expensive subbing coatings. The preferred emulsion bonding layer comprises polyethylene with a density between 0.88 and 0.94 g/cc. Polyethylene in this density range has been shown to provide excellent adhesion to gelatin when the polyethylene is corona discharge treated prior to coating with gelatin based adhesion layers.

In a preferred additional embodiment the nacreous pigment may be in a layer of the photographic label element that is free of silver halide emulsion. It is common knowledge that photographic emulsions have multiple layers in which the light sensitive layers are separated by an interlayer and furthermore have a size overcoat in the topmost position that are not light sensitive. In this embodiment the nacreous material is located above or below a layer or layers that further comprise silver halide. This embodiment is preferred because the nacreous pigments do not have to be fully compatible with the silver halide emulsion and are, therefore, less likely to interfere with image development or keeping. The nacreous appearance is still present after the image is formed and developed. In an additional embodiment the nacreous pigment is in a layer on the surface or adjacent to the surface of said photographic label element. In this embodiment the reflected light of the exposed and developed image creates a nacreous appearance to the image. In yet another preferred embodiment of said photographic label element, said nacreous pigment is in a layer below said bottommost layer comprising silver halide. This embodiment is preferred because light is allowed to expose the silver halide as it passes through the layers, but the secondary light that bounces back from the base is impacted by the nacreous pigments. This provides a very soft nacreous appearance to the image.

In a preferred embodiment of this invention the nacreous pigments comprises mica. Coated mica is preferred because it has a platelet structure that, when coated with metal oxides, has a nacreous appearance that provides a very unique look to an image which is appealing. Furthermore, said mica may be easily dispersed and coated in a layer or layers that comprise silver halide emulsion, as well as layers that are free of or at least substantially free of silver halide emulsion. For the purpose of this invention the term "mica" refers to nacreous materials and includes mica, feldspar, quartz, silicates, modified mica, and mica that has been coated with a metal oxide, mica coated with materials that have a difference in refractive index greater than 0.2. The mica material may be a translucent organic and/or inorganic materials and may have a nacreous effect when viewed from different angles.

In other suitable embodiments of this invention, nacreous pigments may be incorporated in either or both the light sensitive emulsion layers and the size overcoat used to protect the photographic label from handling damage or water in the case of a soap label. Nacreous pigments have been shown to be an effective means to filter UV radiation. This has significant advantage to minimize photographic dye fade.

In an additional embodiment of this invention, said photographic label element comprising a nacreous pigment has an electrical resistant of less than $10^{13}$ log ohms per square. Electrical resistance less than $10^{13}$ is desirable to prevent static buildup and discharge that can cause the light sensitive layer to fog.

In yet an additional embodiment of this invention, said photographic label element comprises nacreous pigment that has a mean particle size between 0.5 and 50 micrometers. Particles less than 0.5 micrometer in size tend not to have a sufficient platelet structure to create a strong nacreous appearance. It should be noted that small particle sizes in the preferred range have less of a scattering impact on the light sensitive layers and, therefore, have minimal interference with the exposure of the silver halide and sharpness. The smaller particle sizes are further desirable with the relatively thin layer of a photographic emulsion to minimize roughness that can cause excessive light scattering. Larger particles are desirable to get more efficient nacreous appearance, but particles greater than 50 micrometers are very rough and difficult to incorporate in or around light sensitive layers. Typically the large particles should be coated in layers several times thicker than the particle.

In a preferred embodiment of this invention said photographic label element has a b* less than 10. A b* less than 10 is desirable for photographic print material because of the customer traditional expectation of a white appearing print. Furthermore, b* less than 10 provides excellent contrast to other colors. There are many color shades of white. Blue whites are desirable to make the whites look whiter, while less blue or more yellow whites are desirable for warmer tones images. Other color tints may be used for other shades of white, while optical brighteners may be used in conjunction with the nacreous pigments to make the whites more blue appearing. Nacreous pigments with colors other than white may be used to create special effects or color schemes.

In this invention the nacreous pigments may comprises between 0.5 and 1000 mg/m$^2$ of the photographic label element. Nacreous pigment levels below 0.5 mg/m$^2$ are difficult to detect and generally do not have a nacreous impact. Nacreous pigment levels above 1000 mg/m$^2$ do not have a proportional improved nacreous appearance for the additional expense. Furthermore, if the level is above 1000 mg/m$^2$, the nacreous pigments tend to stack more vertically and their impact is decreased. In a preferred embodiment of this invention, said nacreous pigments are present in the amount between 7 and 250 mg/m$^2$. Below 7 mg/m$^2$ the nacreous appearance is more difficult to see, while levels above 250 mg/m$^2$ do not have a significantly improved nacreous appearance for the additional expense. When nacreous pigments are incorporated in and/or above silver halide layers, the amount of the nacreous pigment should be kept low to minimize interference with the image exposure. Higher level in the preferred range tend to have a stronger nacreous appearance which is desirable in certain applications for display or youth markets where a different look is valued. In the preferred embodiment of this invention, the nacreous pigment should comprise between 0.1 to 9% by volume of the photographic emulsion. Levels below 0.1% have minimal nacreous appearance, while levels above 9% cause excessive stacking of the platelets which tends to interfere with the nacreous appearance. Additionally it is desirable to have the nacreous pigments as the only pigment in a substantial clear polymer. The inclusion of other solid particles tends to cause more light scattering and, therefore, reduces the nacreous effect.

Nacreous or pearlescence appearing media has shown to be highly desirous from a commercial standpoint. Incorporation of nacreous pigments in a substantially transparent substrate or construction of composite materials containing localized voiding of a specific geometry, orientation, and formulation can produce both "colored" nacreous and "white" nacreous media. For both types, this nacrescence results in perceived depth, luster, and a metallic appearance. Correct measurement of these materials is required for robust design.

For both pigment and voiding methods, "white" nacreous luster is a function of the orientation, as well as the spacing and composition of the materials. The luster and depth appearance of the media are mainly due to the reflected light that reaches the eye. Both pigments and voids that provide a nacreous appearance function as substantially transparent platelets oriented parallel to each other. This results in depth as each platelet reflects some of the incident light while transmitting the rest. Any imperfections due to surface defects or platelet or void orientation misalignments will cause the light to be scattered in a non-specular direction, and will degrade the nacreous appearance of the material.

In addition, the natural tendency for randomness in regards to platelet or void alignment and spacing will render the media incapable of producing color by light interference. Any color produced by one alignment and spacing will have a tendency to be counteracted by other encountered alignments and spacing. However, gross geometric misalignments of the platelets or voids will also result in less than desirable functionality, and a method of measuring this defect is required as well.

FLOP is a test method used to measure the nacreous quality of materials of interest. 45-degree incident light is collected at 10, 45, and 110 degrees from the specular reflection angle. The spectrophotometric output, e.g., CIE L* (L1*, L2*, L3* respectively) is used as follows:

$$FLOP=15(L1-L3^*)^{1.11}/L2^{*0.86}$$

whereby FLOP values between less than 10 have no nacreous appearance and FLOP values greater than 10 are indicative of a nacrescent appearance.

Furthermore, quality monitoring of these nacreous materials, when combined with one or more semitransparent color forming dyes layers, places limitations on the usefulness of measurements taken with typically found reflection densitometers having 0/45 geometry. This is due to the angular dependency of these media. This angular viewing dependency of the media and the inherent randomness of the structure will result in errors"reading out" the dye formed due to the variability of the media at any one collection angle. These highly specular and translucent materials will reflect some light in angular dependent non-specular directions as well. It has been found that although incident light and collection at 0/45 will allow for a prediction of density minimum versus FLOP, these values are no longer predictive, as density increases from density minimum to density maximum as color dye forming layers are added to the media.

This can be explained as a function of the dye density. As density increases, the ability for multiple reflections through the media decreases. As the reflection passes approach one, the nacreous look will no longer be apparent.

Spectrogoniometric measurements can be employed to measure the media at various angles, but spectrogoniometric readings are tedious and the apparatus is expensive. An alternative for quality monitoring purposes to assess the amount of color forming layers coated and subsequently processed would be useful. During a color photographic coating operation, the need to reduce inherent manufacturing variability of color forming coupler levels is required and this data collection by conventional reflection 0/45 densitometry is impeded by the natural variability found in the nacreous media. Slight changes in the reflective properties of the base media will result in more or less light reaching the densitometer which, in turn, can result in an erroneous readout of the formed dye.

One such method to provide correct assessment during a coating operation would be to remove the nacreous properties of the media. This can be accomplished by collecting light from the prepared sample at a grazing angle that would minimize the nacreous layer contributions. Diffuse 8 degree sphere optical geometry handheld spectrophotometers have been shown to meet this need.

In a preferred embodiment of this invention, said photographic label element comprising nacreous pigments wherein said element has a flop measurement of between 2 and 65. Flop measurements below 2 have little or no nacreous appearance, while flop measurements above 65 are difficult to achieve with nacreous pigments.

In a further embodiment of this invention, the photographic label element further comprises a white reflective base that further comprises a surface roughness of less than 0.8 micrometer. Reflective bases greater than 0.8 micrometers tend to exhibit a roughness frequency that greatly reduces the nacreous appearance. Bases with a roughness of less than 0.8 micrometers are generally glossy in overall appearance which tends to maximize the nacreous appearance in an imaging print.

In a preferred embodiment of this invention, the photographic label element comprising a nacreous pigment further comprises at least two exposed and developed images that are folded with the image sides out, and the non-image bearing sides are adhesively joined to form an album page. This embodiment is preferred because it allows the nacreous appearance to be utilized with album pages. Multiple images may be exposed and developed on one sheet of photographic label element that contains nacreous pigment and then folded and joined to form a convenient display. The page can then be punched and used as part of an album page. In an additional embodiment, the exposed and developed photographic label element may be folded using an apparatus for making an album leaf from an image-bearing sheet. The sheet has an image bearing side and a non-image bearing side, comprising:

a first roller about which said image bearing sheet is driven;

a second roller positioned adjacent said first roller so as to form a first nip there between, said second roller is used for driving an adhesive sheet into said first nip against said image bearing sheet that is driven by said first roller; and a third roller positioned adjacent said first roller so as to form a second nip there between, said third and said first roller moving in a direction which caused said image bearing sheet to be folded firmly about said adhesive sheet and move through said second nip so as to form an album leaf.

The imaging elements of this invention are photographic label elements, such as photographic display films and photographic paper, in which the image-forming layer is a radiation-sensitive silver halide emulsion layer. Such emulsion layers typically comprise a film-forming hydrophilic colloid. The most commonly used of these is gelatin, and gelatin is a particularly preferred material for use in this invention. Most of the nacreous pigments useful in this invention are easily dispersed in gelatin. Additional dispersing aids may be used with gelatin or other hydrophilic colloids. Most any aqueous dispersing aid known in the art of pigments and paints may be useful. Useful gelatins include alkali-treated gelatin (cattle bone or hide gelatin), acid-treated gelatin (pigskin gelatin), and gelatin derivatives such as acetylated gelatin, phthalated gelatin, and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic label elements of the present invention can be simple black-and-white or monochrome elements comprising a support bearing a layer of light-sensitive silver halide emulsion, or they can be multilayer and/or multicolor elements.

Color photographic label elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

In addition to emulsion layers, the photographic layer can contain auxiliary layers conventional in photographic label elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers, and the like. The support can be any suitable support as described in this invention. Typical supports include polymeric films, polymeric film laminated to other polymeric, glass, and the like. The important thing is to have translucent support that is both reflective and diffusive. The light-sensitive silver halide emulsions employed in the photographic label elements of this invention can include coarse, regular, or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions, although other hydrophilic colloids can be used in accordance with usual practice. Details regarding the silver halide emulsions are contained in and described in *Research Disclosure,* September 1994, Item 36544, Section I, published by Kenneth Mason Publications, Ltd., Dudley Annex, 12a North Street, Emsworth, Hampshire PO10 7DQ, ENGLAND as well as *Research Disclosure*, Item 36544, September 1994, and the references listed therein, as well as *Research Disclosure*, September 2000, Item 437013, published by Kenneth Mason Publications, Ltd., Dudley Annex, 12a North Street, Emsworth, Hampshire PO10 7DQ, ENGLAND.

The photographic silver halide emulsions utilized in this invention can contain other addenda conventional in the photographic art. Useful addenda are described, for example, in *Research Disclosure*, Item 36544, September 1994, and *Research Disclosure*, September 2000, Item 437013, published by Kenneth Mason Publications, Ltd., Dudley Annex, 12a North Street, Emsworth, Hampshire PO10 7DQ, ENGLAND. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic label element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

In a typical photographic label element which includes a size overcoat, three light sensitive silver halide emulsion units with a color dye forming, interlayers to separate the various light sensitive layers, and a pressure sensitive label base. For the purpose of this invention, the nacreous comprising materials may be added individually to each light sensitive emulsion and interlayer or in more than one layer in any combination. Additionally the nacreous materials may be added to a layer under the emulsion such as in the gel sub or primer layer or as a separate additional layer.

In order to produce a pressure sensitive photographic nacreous label, the liner material that carries the pressure sensitive adhesive, face stock and silver halide imaged layers, the liner material must allow for efficient transport in manufacturing, image printing, image development, label converting and label application equipment. A nacreous label comprising a silver halide imaging layer, a base and a strippable liner adhesively connected by an adhesive to said base, wherein said base has a stiffness of between 15 and 60 millinewtons and an L* is greater than 92.0, and wherein said liner has a stiffness of between 40 and 120 millinewtons is preferred. The photographic label of the invention is preferred as the white, stiff liner allows for efficient transport through photographic printing and processing equipment and improves printing speed compared to typical liner materials that are brown or clear and have little contribution to secondary exposure.

A peelable liner or back is preferred as the pressure sensitive adhesive required for adhesion of the label to the package, can not be transported through labeling equipment without the liner. The liner provides strength for conveyance and protects the pressure sensitive adhesive prior to application to the package. A preferred liner material is cellulose paper. A cellulose paper liner is flexible, strong and low in cost compared to polymer substrates. Further, a cellulose paper substrate allows for a textured label surface that can be desirable in some packaging applications. The paper may be provided with coatings that will provide waterproofing to the paper as the photographic element of the invention must be processed in aqueous chemistry to develop the image. An examples of a suitable water proof coatings applied to the paper are acrylic polymer, melt extruded polyethylene and oriented polyolefin sheets laminated to the paper. Paper is also preferred as paper contains moisture and salt which provides antistatic properties that prevent static sensitization of the silver halide image layers and has been shown to improve labeling in high speed labeling equipment by reducing repellency between the package and the pressure sensitive label. The preferred range of salt to be added to the cellulose paper is between 0.5% and 2.0% by weight of paper fiber. Below 0.4%, little improvement in static dissipation has been observed. Above 2.5%, little improvement in static reduction is observed and therefore is not cost justified.

Further, paper containing sizing agents, known in the photographic paper art and disclosed in U.S. Pat. No. 6,093,521, provide resistance to edge penetration of the silver halide image processing chemistry. An edge penetration of less than 8 mm is preferred as processing chemistry penetrated into the paper greater than 12 mm has been shown to swell causing die cutting problems when face stock matrix is die cut and stripped from the liner. Also, penetration of processing chemistry greater than 12 mm increases the chemistry usage in processing resulting in a higher processing costs.

Another preferred liner material or peelable back is an oriented sheet of polymer. The liner preferably is an oriented polymer because of the strength and toughness developed in the orientation process. Preferred polymers for the liner substrate include polyolefins, polyester and nylon. Preferred polyolefin polymers include polypropylene, polyethylene, polymethylpentene, polystyrene, polybutylene, and mixtures thereof. Polyolefin copolymers, including copolymers of propylene and ethylene such as hexene, butene, and octene are also useful. Polyester is most preferred, as it is has desirable strength and toughness properties required for efficient transport of silver halide pressure sensitive label liner in high speed labeling equipment.

In another preferred embodiment, the liner consists of a paper core to which sheets of oriented polymer are laminated. The laminated paper liner is preferred because the oriented sheets of polymer provide tensile strength which allows the thickness of the liner to be reduced compared to coated paper and oriented polymer sheet provides resistance to curl during manufacturing and drying in the silver halide process.

The tensile strength of the liner or the tensile stress at which a substrate breaks apart is an important conveyance and forming parameter. Tensile strength is measured by ASTM D882 procedure. A tensile strength greater than 120 MPa is preferred as liners less than 110 MPa begin to fracture in automated packaging equipment during conveyance, forming and application to the package.

The coefficient of friction or COF of the liner containing the silver halide imaging layer is an important characteristic as the COF is related to conveyance and forming efficiency in automated labeling equipment. COF is the ratio of the weight of an item moving on a surface to the force that maintains contact between the surface and the item. The mathematical expression for COF is as follows:

$$COF=\mu=(\text{friction force/normal force})$$

The COF of the liner is measured using ASTM D-1894 utilizing a stainless steel sled to measure both the static and dynamic COF of the liner. The preferred static COF for the liner of the invention is between 0.2 and 0.6. As an example, a 0.2 COF is necessary for coating on a label used in a pick-and-place application. The operation using a mechanical device to pick a label and move it to another point requires a low COF so the label will easily slide over the surface of the label below it. At the other extreme, large sheets such as book covers require a 0.6 COF to prevent them from slipping and sliding when they are piled on top of each other in storage. Occasionally, a particular material may require a high COF on one side and a low COF on the other side. Normally, the base material itself, such as a plastic film, foil, or paper substrate, would provide the necessary COF for one side. Application of an appropriate coating would modify the image side to give the higher or lower value. Conceivably, two different coatings could be used with one on either side. COF can be static or kinetic. The coefficient of static friction is the value at the time movement between the two surfaces is ready to start but no actual movement has occurred. The coefficient of kinetic friction refers to the case when the two surfaces are actually sliding against each other at a constant rate of speed. COF is usually measured by using a sled placed on the surface. The force necessary at the onset of sliding provides a measurement of static COF. Pulling the sled at a constant speed over a given length provides a measure of kinetic frictional force.

The preferred thickness of the liner of the invention is between 75 and 225 micrometers. Thickness of the liner is important in that the strength of the liner, expressed in terms of tensile strength or mechanical modulus, must be balanced with the thickness of the liner to achieve a cost efficient design. For example, thick liners that are high in strength are not cost efficient because thick liners will result in short roll lengths compared to thin liners at a given roll diameter. A liner thickness less that 60 micrometer has been shown to cause transport failure in the edge guided silver halide printers. A liner thickness greater than 250 micrometers yields a design that is not cost effective and is difficult to transport in existing silver halide printers.

The liner of the invention preferably has an optical transmission of less than 20%. During the printing of the silver halide labels, exposure light energy is required to reflect from the face stock/liner combination to yield a secondary exposure. This secondary exposure is critical to maintaining high level of printing productivity. It has been shown that liners with an optical transmission of greater than 25% significantly reduces the printing speed of the silver halide label. Further, clear face stock material to provide the "no label look" need an opaque liner to not only maintain printing speed, but to prevent unwanted reflection from printing platens in current silver halide printers.

Since the light sensitive silver halide layers of the invention can suffer from unwanted exposure from static discharge during manufacturing, printing and processing, the line preferably has a resistivity of less than $10^{11}$ ohms/square. A wide variety of electrically-conductive materials can be incorporated into antistatic layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc. have been described previously. However, these antistatic layers typically contain a high volume percentage of electronically conducting materials which are often expensive and impart unfavorable physical characteristics, such as color, increased brittleness, and poor adhesion to the antistatic layer.

In a preferred embodiment of this invention the label has an antistat material incorporated into the liner or coated on the liner. It is desirable to have an antistat that has an electrical surface resistivity of at least $10^{11}$ log ohms/square. In the most preferred embodiment, the antistat material comprises at least one material selected from the group consisting of tin oxide and vanadium pentoxide.

In another preferred embodiment of the invention antistatic material are incorporated into the pressure sensitive adhesive layers. The antistatic material incorporated into the pressure sensitive adhesive layer provides static protection to the silver halide layers and reduces the static on the label which has been shown to aid labeling of containers in high speed labeling equipment. As a stand-alone or supplement to the liner comprising an antistatic layer, the pressure sensitive adhesive may also further comprise an antistatic agent selected from the group consisting of conductive metal oxides, carbon particles, and synthetic smectite clay, or multi-layered with an inherently conductive polymer. In one of the preferred embodiments, the antistat material is metal oxides. Metal oxides are preferred because they are readily dispersed in the thermoplastic adhesive and can be applied to the polymer sheet by any means known in the art. Conductive metal oxides that may be useful in this invention are selected from the group consisting of conductive particles including doped-metal oxides, metal oxides containing oxygen deficiencies, metal antimonates, conductive nitrides, carbides, or borides, for example, $TiO_2$, $SnO_2$, $Al._2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$ ZrN, TiN, TiC, and WC. The most preferred materials are tin oxide and vanadium pentoxide because they provide excellent conductivity and are transparent.

The flexible substrate of the invention contains the necessary tensile strength properties and coefficient of friction properties to allow for efficient transport and application of the images in high speed labeling equipment. The substrate of the invention is formed by applying light sensitive silver halide imaging layers of a flexible label stock that contains a pressure sensitive adhesive. The imaging layers, face stock and pressure sensitive adhesive are supported and transported through labeling equipment using a tough liner material. Because the light sensitive silver halide imaging layers are vulnerable to environmental solvents such as water, coffee and hand oils, an environmental protection layer is preferably applied to the light sensitive silver halide imaging layers after image development.

Illustrated in FIG. 1 is a silver halide pressure sensitive label with a laminated paper liner. Developed silver halide image layer 10 is adhered to face stock 12. Pressure sensitive layer 14 is adhered to face stock 12 containing nacreous mica pigment on the side opposite the developed silver halide image layers. Between pressure sensitive layer 14 and the laminated paper liner 18, is silicone layer 16. During die cutting of the label, the silver halide layer 10, face stock 12 and adhesive layer 14 are cut by a die. During application of the silver halide label to a package, the silicone layer 16 and the laminated paper liner 18 are removed exposing pressure sensitive layer 14 and the photographic label of the invention is adhered to a package by placing pressure sensitive adhesive layer in contact with the package surface.

The environmental protection layer may consist of suitable material that protects the nacreous image from environmental solvents, resists scratching and does not interfere with the image quality. The environmental protection layer is preferably applied to the photographic image after image development because the liquid processing chemistry required for image development must be able to efficiently penetrate the surface of the imaging layers to contact the silver halide and couplers utilizing typical silver halide imaging processes. The environmental protection layer would be generally impervious to developer chemistry. An environmental protection layer where transparent polymer particles are applied to the top most surface of the imaging layers in the presence of an electric field and fused to the top most layer causing the transparent polymer particles to form a continuous polymeric layer is preferred. An electrophotographic toner applied polymer is preferred as it is an effective way to provide a thin, protective environmental layer to the photographic label that has been shown to withstand environmental solvents and damage due to handling.

In another embodiment, the environmental protection layer is coatable from aqueous solution, which survives exposure and processing, and forms a continuous, water-impermeable protective layer in a post-process fusing step. The environmental protection layer is preferably formed by coating polymer beads or particles of 0.1 to 50 $\mu$m in average size together with a polymer latex binder on the emulsion side of a sensitized photographic product. Optionally, a small amount of water-soluble coating aids (viscosifiers, surfactants) can be included in the layer, as long as they leach out of the coating during processing. After exposure and processing, the product with image is treated in such a way as to cause fusing and coalescence of the coated polymer beads, by heat and/or pressure (fusing), solvent treatment, or other means so as to form the desired continuous, water impermeable protective layer.

Examples of suitable polymers from which the polymer particles used in environmental protection layer can be selected include poly(vinyl chloride), poly(vinylidene chloride), poly(vinyl chloride-co-vinylidene chloride), chlorinated polypropylene, poly(vinyl chloride-co-vinyl acetate), poly(vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, dammar gum, ketone resins, maleic acid resins, vinyl polymers, such as polystyrene and polyvinyltoluene or copolymer of vinyl polymers with methacrylates or acrylates, poly(tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly(methyl methacrylate), copolymers with siloxanes and polyalkenes. These polymers can be used either alone or in combination. In a preferred embodiment of the invention, the polymer comprises a polyester or poly (styrene-co-butyl acrylate). Preferred polyesters are based on ethoxylated and/or propoxylated bisphenol A and one or more of terephthalic acid, dodecenylsuccinic acid and fumaric acid as they form an acceptable environmental protection layer that generally survives the rigors of a packaging label.

To increase the abrasion resistance of the environmental protection layer, polymers which are cross-linked or branched can be used. For example, poly(styrene-co-indene-co-divinylbenzene), poly(styrene-co-acrylonitrile-co-divinylbenzene), or poly(styrene-co-butadiene-co-divinylbenzene) can be used.

The polymer particles for the environmental protection layer should be transparent, and are preferably colorless. But it is specifically contemplated that the polymer particle can have some color for the purposes of color correction, or for special effects, so long as the image is viewable through the overcoat. Thus, there can be incorporated into the polymer particle dye which will impart color. In addition, additives can be incorporated into the polymer particle which will give to the overcoat desired properties. For example, a UV absorber can be incorporated into the polymer particle to make the overcoat UV absorptive, thus protecting the image from UV induced fading or blue tint can be incorporated into the polymer particle to offset the native yellowness of the gelatin used in the silver halide imaging layers.

In addition to the polymer particles which form the environmental protection layer there can be combined with the polymer composition other particles which will modify the surface characteristics of the element. Such particle are solid and nonfusible at the conditions under which the polymer particles are fused, and include inorganic particles, like silica, and organic particles, like methylmethacrylate beads, which will not melt during the fusing step and which will impart surface roughness to the overcoat.

The surface characteristics of the environmental protection layer are in large part dependent upon the physical characteristics of the polymer which forms the toner and the presence or absence of solid, nonfusible particles. However, the surface characteristics of the overcoat also can be modified by the conditions under which the surface is fused. For example, the surface characteristics of the fusing member that is used to fuse the toner to form the continuous overcoat layer can be selected to impart a desired degree of smoothness, texture or pattern to the surface of the element. Thus, a highly smooth fusing member will give a glossy surface to the imaged element, a textured fusing member will give a matte or otherwise textured surface to the element, a patterned fusing member will apply a pattern to the surface of the element.

Suitable examples of the polymer latex binder include a latex copolymer of butyl acrylate, 2-acrylamido-2-methylpropanesulfonate, and acetoacetoxyethylmethacrylate. Other latex polymers which are useful include polymers having a 20 to 10,000 nm diameter and a Tg of less than 60° C. suspended in water as a colloidal suspension.

Examples of suitable coating aids for the environmental protection layer include any water soluble polymer or other material that imparts appreciable viscosity to the coating suspension, such as high MW polysaccharide derivatives (e.g. xanthan gum, guar gum, gum acacia, Keltrol (an anionic polysaccharide supplied by Merck and Co., Inc.) high MW polyvinyl alcohol, carboxymethylcellulose, hydroxyethylcellulose, polyacrylic acid and its salts, polyacrylamide, etc). Surfactants include any surface active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide)sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The application of a ultraviolet polymerizable monomers and oligomers to the outermost layer of the developed silver halide imaging layers and subsequent radiation exposure to form a thin cross-linked protective layer is preferred. UV cure polymers are preferred as they can easily be applied to the outermost layer of the silver halide imaging layers and have been shown to provide an acceptable protective layer for the silver halide label material. Preferred UV cure polymers include aliphatic urethane, allyl methacrylate, ethylene glycol dimethacrylate, polyisocyanate and hydroxyethyl methacrylate. A preferred photoinitiator is benzil dimethyl ketal. The preferred intensity of radiation is between 0.1 and 1.5 milliwatt/cm$^2$. Below 0.05, insufficient cross linking occurs yielding a protective layer that does not offer sufficient protection for the labeling of packages.

The application of a pre-formed polymer layer to the outermost surface of the developed label silver halide image to form an environmental protection layer is most preferred. Application of a pre-formed sheet is preferred because pre-formed sheets are tough and durable easily withstanding the environmental solvents and handling forces applied to the silver halide imaged label. Application of the pre-formed polymer sheet is preferable carried out though lamination after image development. An adhesive is applied to either the photographic label or the pre-formed polymer sheet prior to a pressure nip that adheres the two surfaces and eliminates any trapped air that would degrade the quality of the image.

The pre-formed sheet preferably is an oriented polymer because of the strength and toughness developed in the orientation process. Preferred polymers for the flexible substrate include polyolefins, polyester and nylon. Preferred polyolefins include polypropylene, polyethylene, polymethylpentene, polystyrene, polybutylene, and mixtures thereof. Polyolefin copolymers, including copolymers of propylene and ethylene such as hexene, butene, and octene are also useful. Polypropylene is most preferred, as it is low in cost and has desirable strength and toughness properties required for a pressure sensitive label.

The application of a synthetic latex to the developed silver halide label image is another preferred environmental protection layer. A coating of synthetic latex has been shown to provide an acceptable environmental protection layer and can be coated in an aqueous solution eliminating exposure to solvents. The coating of latex has been shown to provide an acceptable environmental protection layer for the silver halide packaging label. Preferred synthetic latexes for the environmental protection layer are made by emulsion polymerization techniques from styrene butadiene copolymer, acrylate resins, and polyvinyl acetate. The preferred particles size for the synethetic latex ranges from 0.05 to 0.15 $\mu$m. The synthetic latex is applied to the outermost layer of the silver halide imaging layers by known coating methods that include rod coating, roll coating and hopper coating. The synthetic latexes must be dried after application and must dry transparent so as not to interfere with the quality of the silver halide image.

The face stock material, or the flexible substrate utilized in this invention on to which the light sensitive silver halide imaging layers are applied, must not interfere with the silver halide imaging layers. Further, the face stock material of this invention needs to optimize the performance of the silver halide imaging system. Suitable flexible substrates must also perform efficiently in a automated packaging equipment for the application of labels to various containers. A preferred flexible substrate is cellulose paper. A cellulose paper substrate is flexible, strong and low in cost compared to polymer substrates. Further, a cellulose paper substrate allows for a textured label surface that can be desirable in some packaging applications. The paper may be provided with coatings that will provide waterproofing to the paper as the photographic element of the invention must be processed in aqueous chemistry to develop the silver halide image. An example of a suitable coating is acrylic or polyethylene polymer.

Polymer substrates are another preferred face stock material because they are tear resistant, have excellent conformability, good chemical resistance and high in strength. Preferred polymer substrates include polyester, oriented polyolefin such as polyethylene and polypropylene, cast polyolefins such as polypropylene and polyethylene, polystyrene, acetate and vinyl. Polymers are preferred as they are strong and flexible and provide an excellent surface for the coating of silver halide imaging layers. Nacreous pigments are preferably added to the oriented polymer layers of the facestock. By adding nacreous pigment to the facestock, the nacreous pigments of the invention create multiple reflection planes that provide a nacreous silver halide formed image. Nacreous pigments are preferably added to the skin layers and/or the core layers to provide the desired nacreous appearance. Nacreous pigments located adjacent to the imaging layers are more effective than nacreous pigments added to the core. When nacreous pigments are added to a oriented polymer skin layer or adjacent polymer layer, they preferably added in an amount between 1 and 4% by weight. Less than 0.5%, the FLOP value of the image is less than 5, above 5% addition the concentration of pigments begins to darken the oriented polymer sheet, reducing the desired whiteness position of the sheet.

Biaxially oriented polyolefin sheets are preferred as they are low in cost, have excellent optical properties that optimize the silver halide system and can be applied to packages in high speed labeling equipment. Microvoided composite biaxially oriented sheets are most preferred because the voided layer provides opacity and lightness without the need for $TiO_2$. Also, the voided layers of the microvoided biaxially oriented sheets have been shown to significantly reduce pressure sensitivity of the silver halide imaging layers. Microvoided biaxially oriented sheets are conveniently manufactured by coextrusion of the core and surface layers, followed by biaxial orientation, whereby voids are formed around void-initiating material contained in the core layer. Such composite sheets are disclosed in U.S. Pat. Nos. 4,377,616; 4,758,462; 4,632,869 and 5,866,282. The biaxially oriented polyolefin sheets also may be laminated to one or both sides of a paper sheet to form a label with greater stiffness if that is needed.

The flexible nacreous polymer face stock substrate may contain more than one layer. The skin layers of the flexible substrate can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Voided biaxially oriented polyolefin nacreous sheets are a preferred flexible face stock substrate for the coating of light sensitive silver halide imaging layers. Voided films are preferred as they provide opacity, whiteness and image sharpness to the image. "Void" is used herein to mean devoid of added solid and liquid matter, although it is likely the "voids" contain gas. The void-initiating particles which remain in the finished packaging sheet core should be from 0.1 to 10 $\mu$m in diameter and preferably round in shape to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material for the flexible face stock substrate may be selected from a variety of materials and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms, acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above-described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer void initiating particles include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly (methyl methacrylate). Most preferably, it is polystyrene, and the cross-linking agent is divinylbenzene.

Processes well known in the art yield nonuniformly sized void initiating particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, or calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

The total thickness of the topmost skin layer of the polymeric face stock substrate may be between 0.20 $\mu$m and 1.5 $\mu$m, preferably between 0.5 and 1.0 $\mu$m. Below 0.5 $\mu$m any inherent nonplanarity in the coextruded skin layer may result in unacceptable color variation. At skin thickness greater than 1.0 $\mu$m, there is a reduction in the photographic optical properties such as image resolution. At thickness greater than 1.0 $\mu$m, there is also a greater material volume to filter for contamination such as clumps or poor color pigment dispersion.

Addenda may be added to the top most skin layer of the flexible face stock substrate to change the color of the imaging element. For labeling use, a white substrate with a slight bluish tinge is preferred. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, and Irgalite organic blue pigments. Optical brightener may also be added to the skin layer to absorb UV energy and emit light largely in the blue region. $TiO_2$ may also be added to the skin layer. While the addition of $TiO_2$ in the thin skin layer of this invention does not significantly contribute to the optical performance of the sheet, it can cause numerous manufacturing problems such as extrusion die lines and spots. The skin layer substantially free of $TiO_2$ is preferred. $TiO_2$ added to a layer between 0.20 and 1.5 $\mu$m does not substantially improve the optical properties of the support, will add cost to the design, and will cause objectionable pigments lines in the extrusion process.

Addenda may be added to the core matrix and/or to one or more skin layers to improve the optical properties of the flexible substrate. Titanium dioxide is preferred and is used in this invention to improve image sharpness or MTF, opacity, and whiteness. The $TiO_2$ used may be either anatase or rutile type. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments known in the art to improve photographic optical responses may also be used in this invention. Examples of other pigments known in the art to improve whiteness are talc, kaolin, $CaCO_3$, $BaSO_4$, ZnO, $TiO_2$, ZnS, and $MgCO_3$. The preferred $TiO_2$ type is anatase, as anatase $TiO_2$ has been found to optimize image whiteness and sharpness with a voided layer.

Addenda may be added to the flexible face stock substrate of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside as sunlight contains ultraviolet energy and may be used to optimize image quality for consumer and commercial applications.

Addenda known in the art to emit visible light in the blue spectrum are preferred. Consumers generally prefer a slight blue tint to the density minimum areas of a developed image defined as a negative b* compared to a neutral density minimum defined as a b* within one b* unit of zero b* is the measure of yellow/blue in CIE (Co mission Internationale de L'Eclairage) space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated with a ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore, is it not cost effective to add optical brightener to the biaxially oriented sheet when the b* is changed by less than 1 b* unit. An emission greater that 5 b* units would interfere with the color balance of the images making the whites appear too blue for most consumers.

The preferred addenda is an optical brightener. An optical brightener is a colorless, fluorescent, organic compound that absorbs ultraviolet light and emits it as visible blue light. Examples include, but are not limited to, derivatives of 4,4'-diaminostilbene-2,2'-disulfonic acid, coumarin derivatives such as 4-methyl-7-diethylaminocoumarin, 1-4-Bis (O-Cyanostyryl)Benzol and 2-Amino-4-Methyl Phenol.

The voids provide added opacity to the flexible substrate. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides advantages in the optical performance of the final image.

Voided layers of the flexible face stock substrate are more susceptible than solid layers to mechanical failure, such as cracking or delamination from adjacent layers. Voided structures that contain $TiO_2$, or are in proximity to layers containing $TiO_2$, are particularly susceptible to loss of mechanical properties and mechanical failure with long-term exposure to light. $TiO_2$ particles initiate and accelerate the photooxidative degradation of polypropylene. The addition of a hindered amine stabilizer to at least one layer of a multilayer biaxially oriented film and in the preferred embodiment in the layers containing $TiO_2$ and, furthermore, in the most preferred embodiment the hindered amine is in the layer with $TiO_2$, as well as in the adjacent layers, that improvements to both light and dark keeping image stability are achieved.

The optical brightener may be added to any layer in the multilayer coextruded flexible face stock substrate. The preferred location is adjacent to or in the exposed surface layer of said sheet. This allows for the efficient concentration of optical brightener.

When the desired weight percentage loading of the optical brightener begins to approach a concentration at which the optical brightener migrates to the surface of the support forming crystals in the imaging layer, the addition of optical brightener into the layer adjacent to the exposed layer is preferred. In prior art imaging supports that use optical brightener, expensive grades of optical brightener are used to prevent migration into the imaging layer. When optical brightener migration is a concern, as with light sensitive silver halide imaging systems, the preferred exposed layer comprises polyethylene that is substantially free of optical brightener. In this case, the migration from the layer adjacent to the exposed layer is significantly reduced because the exposed surface layer acts as a barrier for optical brightener migration allowing for much higher optical brightener levels to be used to optimize image quality. Further, locating the optical brightener in the layer adjacent to the exposed layer allows for a less expensive optical brightener to be used as the exposed layer, which is substantially free of optical brightener, prevents significant migration of the optical brightener. Another preferred method to reduce unwanted optical brightener migration in biaxially oriented sheets of this invention is to use polypropylene for the layer adjacent to the exposed surface.

The coextrusion, quenching, orienting, and heat setting of the flexible face stock substrate may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature and below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers, while restraining to some degree the sheet against retraction in both directions of stretching.

By having at least one nonvoided skin on the microvoided core, the tensile strength of the flexible face stock substrate is increased and makes the sheet more manufacturable. The higher tensile strength also allows the sheets to be made at wider widths and higher draw ratios than when sheets are made with all layers voided. Coextruding the layers further simplifies the manufacturing process.

In another embodiment of the invention, a flexible nacreous label base that is transparent is preferred. A transparent flexible label base is used to provide a clear pressure sensitive label particularly useful for labeling applications that allow the contents of the package to be viewed though the label. Examples include wine bottle labeling, shampoo bottle labeling and beverage bottles that utilize clear or colored glass. For this invention, "transparent" material is defined as a material that has a spectral transmission greater than 90%. For a imaging element, spectral transmission is the ratio of the transmitted power to the incident power and is expressed as a percentage as follows; $T_{RGB}=10^{-D}*100$ where D is the average of the red, green and blue Status A transmission density response measured by an X-Rite model 310 (or comparable) photographic transmission densitometer.

A flexible label base that has an optical transmission less than 20% is preferred for most applications. Optical transmission less than 20% provide a superior opaque silver halide pressure sensitive label that is highly reflective. Opaque, highly reflective labels are useful for pressure sensitive labeling against a background that is dark and would interfere with the quality of the image. An example would be the labeling of a black package, a label base with optical transmission greater than 20% would darken the image, resulting is a loss of low density detail such as facial detail content.

A pressure sensitive photographic nacreous label adhesive is utilized in the invention to allow the developed silver halide packaging label to be adhered to the surface of the package typically utilizing high speed packaging equipment. "Peelable separation" or "peel strength" or "separation force" is a measure of the amount of force required to separate the silver halide label from the package to which the label has been applied. The peel strength is the amount of force required to separate two surfaces that are held together by internal forces of the photographic label adhesive which consist of valence forces or interlocking action, or both. Peel strength is measured using an Instron gauge and peeling the sample at 180 degrees with a crosshead speed of 1.0 meters/min. The sample width is 5 cm and the distance peeled is 10 cm in length.

A peelable photographic nacreous label adhesive is utilized to allow the consumer to separate the label from the package. Separation of the label from the package would allow for example, rebate coupons to be attached to the package or used to for consumer promotions. For a peelable photographic label adhesive, the preferred peel strength between the silver halide pressure sensitive label and the package is no greater than 80 grams/cm. A peel strength greater than 100 grams/cm, consumers would begin to have difficulty separating the image from the package. Further, at peel strengths greater than 110 grams/cm, the force is beginning to approach the internal strength of paper substrate, causing an unwanted fracture of the paper substrate before the separation of the image.

Upon separation of the image from the substrate, the peelable photographic nacreous label adhesive of this invention has a preferred repositioning peel strength between 20 grams/cm and 100 grams/cm. Repositioning peel strength is the amount of force required to peel the separated image containing an photographic label adhesive from a stainless steel block at 23° C. and 50% RH. At repositioning peel strengths less than 15 grams/cm, the photographic label adhesive lacks sufficient peel strength to remain adhered to a variety of surfaces such as refrigerators or photo albums. At peel strengths greater than 120 grams/cm, the photographic label adhesive of this invention is too aggressive, not allowing the consumer to later reposition the image.

The peelable photographic nacreous label adhesive of this invention may be a single layer or two or more layers. For two or more photographic label adhesive layers, one of the photographic label adhesive layers preferentially adheres to the label base. As the image is separated from the substrate, this allows the photographic label adhesive of this invention be adhered to the label base for repositioning.

A substrate that comprises a release layer for a photographic label adhesive that repositions is preferred. The release layer allows for uniform separation of the photographic label adhesive at the photographic label adhesive base interface. The release layer may be applied to the liner by any method known in the art for applying a release layer to substrates. Examples include silicone coatings, tetrafluoroethylene fluorocarbon coatings, fluorinated ethylene-propylene coatings, and calcium stearate.

Suitable photographic label adhesives of this invention must not interact with the light sensitive silver halide imaging system so that image quality is deteriorated. Further, since photographic elements of this invention must be photoprocessed, the performance of the photographic label adhesive of this invention must not be deteriorated by photographic processing chemicals. Suitable photographic label adhesive may be inorganic or organic, natural or synthetic, that is capable of bonding the image to the desired surface by surface attachment. Examples of inorganic photographic label adhesives are soluble silicates, ceramic and thermosetting powdered glass. Organic photographic label adhesives may be natural or synthetic. Examples of natural organic photographic label adhesives include bone glue, soybean starch cellulosics, rubber latex, gums, terpene, mucilages and hydrocarbon resins. Examples of synthetic organic photographic label adhesives include elastomer solvents, polysulfide sealants, theromplastic resins such as isobutylene and polyvinyl acetate, theromsetting resins such as epoxy, phenoformaldehyde, polyvinyl butyral and cyanoacrylates and silicone polymers.

For single or multiple layer photographic label adhesive systems, the preferred photographic label adhesive composition is selected from the group consisting of natural rubber, syntheic rubber, acrylics, acrylic copolymers, vinyl polymers, vinyl acetate-, urethane, acrylate-type materials, copolymer mixtures of vinyl chloride-vinyl acetate, polyvinylidene, vinyl acetate-acrylic acid copolymers, styrene butadiene, carboxylated stryrene butadiene copolymers, ethylene copolymers, polyvinyl alcohol, polyesters and copolymers, cellulosic and modified cellulosic, starch and modified starch compounds, epoxies, polyisocyanate, polyimides.

For single or multiple layer photographic label adhesive systems, the preferred permanent photographic nacreous label adhesive composition is selected from the group consisting of epoxy, phenoformaldehyde, polyvinyl butyral, cyanoacrylates, rubber based photographic label adhesives, styrene/butadiene based photographic label adhesives, acrylics and vinyl derivatives. Peelable photographic label adhesives and permanent photographic label adhesives may be used in combination in the same layer or in different locations in the photographic support structure. An example of a combination photographic label adhesive structure is a peelable photographic label adhesive between the top biaxially oriented sheet and the base materials and a permanent photographic label adhesive between the bottom biaxially oriented sheet and the base material. In the case of a clear facestock, the adhesive preferably contains nacreous pigments. By providing a clear facestock and nacreous pigments added to the pressure sensitive adhesive layer, a nacreous photographic label is formed.

The silver halide imaging layers on a pressure sensitive substrate preferably are applied to a variety of packages in automated labeling equipment. Preferred package types are bottles, can, stand up pouch, box and a bag. The packages may contain materials that require a package for sale. Preferred materials that are packaged include liquids and particulate.

The silver halide packaging label of the invention preferably has a thickness of less than 600 $\mu$m. A silver halide packaging label greater than 650 $\mu$m offers no significant improvement in either imaging quality or packaging label performance. Further, transport through high speed packaging equipment is difficult at a photographic label thickness greater than 650 $\mu$m and stripping the photographic labels utilizing the Bernoulli method is difficult if the thickness of the photographic label exceeds 700 $\mu$m.

The following is an example of a preferred nacreous opaque, reflective silver halide pressure sensitive label structure that has an environmental protection layer (EPL) applied to the outermost silver halide imaging layer. The polyethylene and polypropylene layers are an integral biaxially oriented sheet, to which the pressure sensitive adhesive and liner material are laminated prior to the coating of the light sensitive silver halide imaging layers.

| |
|---|
| 7.5 $\mu$m ground styrene butyl acrylate fused EPL |
| Layer of silver halide formed image with metal oxide coated mica |
| Polyethylene with a density of 0.925 g/cc |
| Polypropylene with 12% $TiO_2$ and optical brightener |
| Polypropylene voided layer with a density of 0.50 g/cc |
| Polypropylene |
| Acrylic pressure sensitive adhesive |
| Cellulose paper peelable back |

The following is another example of a preferred nacreous clear silver halide pressure sensitive label structure that has an environmental protection layer (EPL) applied to the outermost developed silver halide imaging layer. The polyethylene and polypropylene layers are an integral biaxially oriented sheet, to which the pressure sensitive adhesive and liner material are laminated prior to the coating of the light sensitive silver halide imaging layers.

| |
|---|
| Oriented polypropylene EPL |
| Acrylic pressure sensitive adhesive |
| Layer of silver halide formed image |
| Polyethylene with a density of 0.925 g/cc and blue tint |
| Polypropylene with optical brightener and metal oxide coated mica |
| Polypropylene |
| Acrylic pressure sensitive adhesive and metal oxide coated mica |
| Polyester peelable back |

The following examples illustrate the practice of this invention. They are not intended to be exhaustive of all possible variations of the invention. Parts and percentages are by weight unless otherwise indicated.

EXAMPLES

In this example, nacreous pigment is added to several addition points in a typical light sensitive silver halide emulsion. The nacreous pigment containing imaging layers are applied to a base material suitable for labeling packages. The addition of the nacreous pigment to the silver halide imaging layers provides a nacreous appearance to the silver halide images. This example will show the improvement in the FLOP value for the nacreous images compared to a silver halide imaging layers that do not contain nacreous pigment.

Examples 1 to 10

Examples 1 to 10 include a three-color emulsion prepared as described above. The light sensitive emulsion is coated on a photographic label base material as described below:

Biaxially Oriented Polyolefin Face Stock

A composite sheet polyolefin sheet (70 $\mu$m thick) (d=0.68 g/cc) consisting of a microvoided and oriented polypropylene core (approximately 60% of the total sheet thickness), with a homopolymer non-microvoided oriented polypropylene layer on each side of the voided layer; the void initiating material used was poly(butylene terephthalate). The polyolefin sheet had a skin layer consisting of polyethylene and a blue pigment. The polypropylene layer adjacent the voided layer contained 8% rutile $TiO_2$. The silver halide imaging layers were applied to the blue tinted polyethylene skin layer.

Pressure Sensitive Adhesive

Permanent solvent based acrylic adhesive 12 $\mu$m thick.

Laminated Paper Liner

A laminated liner that consisted of a cellulose paper core (80 micrometers thick) on to which a biaxially oriented sheet of polypropylene was extrusion laminated to the back side utilizing LDPE resin. The backside oriented polypropylene contained a roughness layer to allow for efficient transport in photographic printing equipment. The roughness layer consisted of a mixture of polyethylene and polypropylene immiscible polymers. The top side of the liner was extrusion coated with LDPE for a silicone hold out. The cellulose paper contained 8% moisture and 1% salt for conductivity. The total thickness of the laminated paper liner was 128 micrometers and the stiffness was 80 millinewtons in both the machine and cross directions. The paper liner was coated with a silicone release coat adjacent to the extruded LDPE layer.

Structure of the base for the photographic packaging label material of the example is as follows:

| |
|---|
| Voided polypropylene sheet |
| Acrylic pressure sensitive adhesive |
| Silicone coating |
| Laminated paper liner |

In the control and sample 7 there are no nacreous pigments in any layer, while in Examples 1 to 6 and 8 to 10, a nacreous pigment was placed in at least one layer. Table 4 below indicates the layer or layers that contained the nacreous pigment. The nacreous pigment used was Afflair 110, a fine particle blue white pigment supplied by EM Industries, Inc. The pigment was dispersed in gelatin using typical mixing. The gel lay down was approximately 39 g/m$^2$, and the pigment weight was coated at 19.4 g/m$^2$ in each layer, and a second series was coated at 190 g/m$^2$. The coating layer was dried and then an image was exposed and developed using RA-4 chemistry.

TABLE 2

| Size Overcoat |
|---|
| Red-sensitized |
| cyan dye image-forming silver halide emulsion unit |
| Interlayer |
| Green-sensitized |
| magenta dye image-forming silver halide emulsion unit |
| Interlayer |
| Blue-sensitized |
| yellow dye image-forming silver halide emulsion unit |
| Polypropylene facestock |
| Acrylic pressure sensitive adhesive |
| Silicone release |
| Laminated paper liner |

Example 11 was the same as the other examples except that it contains one extra layer in the emulsion coating in the bottommost position. This layer contained approximately 45 g/m$^2$ of photo grade gelatin and 0.5% by volume of the same nacreous pigment described above.

TABLE 4

| | Example | | | | | | | | | | | |
|---|---|---|---|---|---|---|---|---|---|---|---|---|
| | 1 | 2 | 3 | 4 | 5 | 6 | 7 | 8 | 9 | 10 | 11 | Control |
| SOC | Y | N | N | N | N | N | N | Y | Y | N | N | N |
| Red Sensitive Layer | N | Y | N | N | N | N | N | Y | N | Y | N | N |
| Interlayer | N | N | Y | N | N | N | N | Y | Y | N | N | N |
| Green Sensitive layer | N | N | N | Y | N | N | N | Y | N | Y | N | N |
| Interlayer | N | N | N | N | Y | N | N | Y | Y | N | N | N |
| Blue sensitive Layer | N | N | N | N | N | Y | N | Y | N | Y | N | N |
| Sub Coating Base | N | N | N | N | N | N | N | N | N | N | Y | N |

Y means the presence of a nacreous pigment.

N means no nacreous pigment.

After the image was exposed and developed, the samples were viewed by visual examination under typical room light condition of a cool white fluorescent light.

The visual examination results are tabulated in Table 5. When viewing the samples, the print is rotated through an incident angle range from 0 to 70 degrees from the viewer. The viewer is looking for a rich lustrous appearance.

TABLE 5

| Example | Nacreous Appearance Observed |
|---|---|
| 1 | Yes |
| 2 | Yes |
| 3 | Yes |
| 4 | Yes |
| 5 | Yes |
| 6 | Yes |
| 7 | No |
| 8 | Yes |
| 9 | Yes |
| 10 | Yes |
| 11 | Yes |
| Control | No |

As the data from Table 5 indicate, whenever the nacreous pigment is present in a layer of the emulsion and even in the sub layer of the emulsion, there is an observed nacreous appearance. The observation was a visual assessment of the sample by reflected light. Because images in examples 1–10 all had exhibited a nacreous appearance, they combine the high quality of silver halide images with the eye catching nacreous appearance that has significant commercial value as a packaging label. Further, because the silver halide imaging layers containing nacreous pigment were applied to a label material, the nacreous image can be applied to packages utilizing a variety of labeling techniques including high speed labeling using the Bernoulli label stripping method. While examples 1–6, 8 and 10 all exhibited a nacreous appearance, the control sample (sample 11) did not have a nacreous pigment in the emulsion and thus did not have a nacreous appearance.

While this example was directed at a silver halide nacreous image formed by adding nacreous pigment to the silver halide imaging layers, nacreous appearing label can also be result from addition of the nacreous pigment in the facestock and/or pressure sensitive adhesive. The nacreous appearing label of the invention may also be the result of nacreous pigment in the facestock and/or adhesive in combination with nacreous pigment in the silver halide imaging layers. In order for the nacreous materials of this example to be useful for labeling packages, it is understood that the label need protection against scratching, moisture and fingerprinting. Methods known in the art for protecting printed labels are useful for protecting the nacreous silver halide image layers. Finally, while this invention is directed toward a nacreous pressure sensitive label suitable for labeling packages, bottles and bags, the nacreous silver halide label of the invention is useful for commercial display and sticker prints particularly for the youth market.

The invention has been described in detail with particular reference to certain preferred embodiments thereof, but it will be understood that variations and modifications can be effected within the spirit and scope of the invention.

What is claimed is:

1. A packaging material comprising at least one layer comprising photosensitive silver halide, at least one layer comprising nacreous pigment, and at least one layer comprising a pressure sensitive adhesive.

2. The packaging material of claim 1 wherein said nacreous pigment is in a layer comprising silver halide emulsion.

3. The packaging material of claim 1 wherein said nacreous pigment is in a layer free of silver halide emulsion.

4. The packaging material of claim 1 wherein said nacreous pigment is in a layer on the surface or adjacent the surface of said photographic element.

5. The packaging material of claim 1 wherein said nacreous pigment is in a layer below said bottommost layer comprising silver halide.

6. The packaging material of claim 1 wherein said nacreous pigment comprises mica.

7. The packaging material of claim 1 wherein said nacreous pigment has a mean particle size between 0.5 and 50 micrometers.

8. The packaging material of claim 1 wherein said nacreous pigment is present in an amount between 0.5 and 1000 $mg/m^2$.

9. The packaging material of claim 1 wherein said nacreous pigment is present in an amount between 7 and 400 $mg/m^2$.

10. The packaging material of claim 1 wherein said nacreous pigment is present in more than one interlayer between layers containing dye forming coupler.

11. The packaging material of claim 10 wherein said nacreous pigment is present in a layer below the bottom layer containing silver halide emulsion.

12. The packaging material of claim 1 wherein said nacreous pigment comprises at least one member selected from the group consisting of mica, modified mica, fledspar, and quartz.

13. The packaging material of claim 1 wherein said nacreous pigment is colored.

14. The packaging material of claim 13 wherein said nacreous pigment has an L* of greater than 92.

15. The packaging material of claim 1 wherein said element has a FLOP of between 2 and 65.

16. The packaging material of claim 12 wherein said modified mica comprises a metal oxide on the surface of the mica.

17. The packaging material of claim 16 wherein said metal oxide comprises at least one member selected from the group consisting of titanium, aluminum, barium, iron, zinc, zirconium, bismuth vanadate, nickel titanate, and chromium titanate.

18. The packaging material of claim 17 wherein said metal oxide comprises titanium, aluminum, or barium.

19. The packaging material of claim 1 comprises silicate coated with a material that has a difference in refractive index of 0.2 or greater.

20. The packaging material of claim 1 wherein said nacreous pigment is comprises between 0.1 to 9% by volume of the image layer.

21. The packaging material of claim 1 comprising a nacreous pigment further comprises electrical resistance of less than $10^{13}$ log ohms per square.

22. The packaging material of claim 1 wherein said nacreous pigment further comprises ultraviolet protection.

23. A label material comprising at least one layer comprising photosensitive silver halide, at least one layer comprising nacreous pigment, a base and a strippable liner adhesively connected by an adhesive to said base, wherein said base has a stiffness of between 15 and 60 millinewtons and an L* is greater than 92.0, and wherein said liner has a stiffness of between 40 and 120 millinewtons.

24. The label of claim 23 wherein said base has a thickness of between 40 and 75 $\mu$m.

25. The label of claim 24 wherein said liner comprises cellulose fiber paper.

26. The label of claim 25 wherein said paper has an edge penetration of less than 8 mm.

27. The label of claim 24 wherein said base further comprises nacreous pigments between 1 and 4% weight of the base polymer.

28. The label of claim 24 wherein said label has a FLOP of between 2 and 65.

29. The label of claim 24 wherein said liner has a tensile strength of greater than 120 MPa.

30. The label of claim 24 wherein said liner has a silicone coating on the side towards the adhesive.

31. The label of claim 24 wherein said adhesive contains nacreous pigment.

32. The label of claim 24 wherein said base comprises oriented polyolefin or oriented polyester polymer.

33. The label of claim 24 wherein said base comprises an oriented polymer having a voided layer and at least one layer comprising titanium dioxide between said voided layer and the surface adjacent the silver halide imaging layer.

34. The label of claim 24 wherein said liner comprises a cellulose fiber paper and a biaxially oriented polymer sheet.

35. The label of claim 24 wherein said liner has a coefficient of friction between 0.20 and 0.60.

36. The label of claim 24 wherein said base comprises an oriented polymer having a voided layer and a layer containing nacreous pigment between said photosensitive layer and voided layer.

37. A method of labeling comprising providing a label comprising comprising at least one layer comprising photosensitive silver halide, at least one layer comprising nacreous pigment, a base and a strippable liner adhesively connected by an adhesive to said base, wherein said base has a stiffness of between 15 and 60 millinewtons and an L* is greater than 92.0, and wherein said liner has a stiffness of between 40 and 120 millinewtons, imagewise exposing said silver halide imaging layer with a collimated beam of actinic radiation, developing an image, removing said liner and adhesively adhering said label to a package.

38. The method of claim 37 wherein prior to removing said liner an environmental protection layer is applied to said developed image.

39. The method of claim 38 wherein after developing an image said image and base are die cut, and matrix material is removed.

40. The method of claim 38 wherein developed silver halide image is further provided with ink jet printed area.

41. The method of claim 38 wherein developed silver halide image is further provided with a flexographic printed area.

42. A method of forming a two-sided image member comprising providing comprising at least one layer comprising photosensitive silver halide, at least one layer comprising nacreous pigment, a base and a strippable liner adhesively connected by an adhesive to said base, wherein said base has a stiffness of between 15 and 60 millinewtons and an L* is greater than 92.0, and wherein said liner has a stiffness of between 40 and 120 millinewtons, imagewise exposing said silver halide imaging layer with a collimated beam of actinic radiation to form a plurality of images, developing said images, cutting a portion of said imaging member bearing at least two images, removing said liner and folding said cut portion such that at least one image is on each side.

43. The method of claim 42 further comprising punching holes suitable for placement into an album.

* * * * *